US007517227B2

(12) United States Patent
Lin

(10) Patent No.: US 7,517,227 B2
(45) Date of Patent: Apr. 14, 2009

(54) ELECTRONIC DEVICE

(75) Inventor: Chin-Chi Lin, Keelung (TW)

(73) Assignee: Lotes Co., Ltd, Anloku, Keelung (TW)

( * ) Notice: Subject to any disclaimer, the term of this patent is extended or adjusted under 35 U.S.C. 154(b) by 0 days.

(21) Appl. No.: 12/025,325

(22) Filed: Feb. 4, 2008

(65) Prior Publication Data

US 2008/0299808 A1 Dec. 4, 2008

(30) Foreign Application Priority Data

Jun. 2, 2007 (CN) ..... 2007 2 0048333 U

(51) Int. Cl.
*H01R 12/00* (2006.01)

(52) U.S. Cl. ..... 439/66

(58) Field of Classification Search ..... 439/66, 439/69, 71, 73, 74

See application file for complete search history.

(56) References Cited

U.S. PATENT DOCUMENTS 5,947,749 A * 9/1999 Rathburn ..... 439/66

* cited by examiner

*Primary Examiner*—Ross N Gushi
(74) *Attorney, Agent, or Firm*—Morris Manning Martin LLP; Tim Tingkang Xia, Esq.

(57) ABSTRACT

An electronic device electrically connected to an external electronic component is provided. The electronic device comprises first conductors for contacting the external electronic component and a base. The base has holes with second conductors disposed on inner walls thereof and an elastic body having terminal receiving holes for receiving the first conductors. The first and second conductors and the elastic body are disposed at appropriate positions. When the external electronic device presses and contacts the first conductors, the elastic body is forced to deform, and the first conductors are made to move to contact the second conductors. As the elastic body has good elasticity, the first conductors after being compressed can contact the second conductors of the base, and thus soldering is not required, which facilitates the electrical connection to a chip module.

15 Claims, 4 Drawing Sheets

ELECTRONIC DEVICE

BACKGROUND OF THE INVENTION

1. Field of the Invention

The invention relates to an electronic device and, more particularly, to an electronic device electronically connected to a chip module.

2. Description of the Prior Art

Currently, in order to electrically connect a chip module to a circuit board, an electrical connector is first fixed on the circuit board to establish an electrical connection between conductive terminals of the electrical connector and conductive pads of the circuit board. Then, the chip module is fixed on the electrical connector to establish an electrical connection between the chip module and the conductive terminals. In this manner, the conductive terminals serve as a medium to allow the chip module to be electrically connected to the circuit board. Therefore, it is crucial to establish the electrical connection between the conductive terminals and the circuit board.

Generally speaking, a conventional electrical connector includes an insulated body and conductive terminals arranged inside the insulated body. The conductive terminals are soldered to the circuit board, and each conductive terminal is corresponding to one of the conductive pads on the circuit board, so as to allow the chip module to be electrically connected to the circuit board. However, as the number of the conductive terminals is great and the size of conductive terminals is very small, in the course of soldering, false soldering or poor soldering of the conductive terminals often occurs due to external conditions or soldering errors that cannot be overcome. Thus, the conductive terminals cannot be electrically connected to the conductive pads effectively, which greatly influences the electrical connection between the chip module and the circuit board.

Therefore, it is necessary to provide a new electronic device to overcome the aforesaid defects.

SUMMARY OF THE INVENTION

Accordingly, a scope of the invention is to provide an electronic device having first conductors that contact second conductors of a circuit board after being compressed, so as to establish an electrical connection to a module chip effectively.

In order to achieve the aforesaid scope, the electronic device electrically connected to an external electronic component according to the invention comprises first conductors for contacting the external electronic component and a base. The base has holes with second conductors disposed on inner walls thereof and an elastic body having terminal receiving holes for receiving the first conductors. The first conductors, the second conductors, and the elastic body are disposed at appropriate positions. When the external electronic component presses and contacts the first conductors, the elastic body is forced to deform and the first conductors are made to move to contact the second conductors.

As the elastic body of the invention has good elasticity, the first conductors after being compressed can contact the second conductors of the base, and thus soldering is not required, which thus facilitates the electrical connection to a chip module.

The advantage and spirit of the invention may be understood by the following recitations together with the appended drawings.

BRIEF DESCRIPTION OF THE APPENDED DRAWINGS

DETAILED DESCRIPTION OF THE INVENTION

The electronic device of the invention will be further described hereinafter with reference to the appended drawings.

Figure 1:
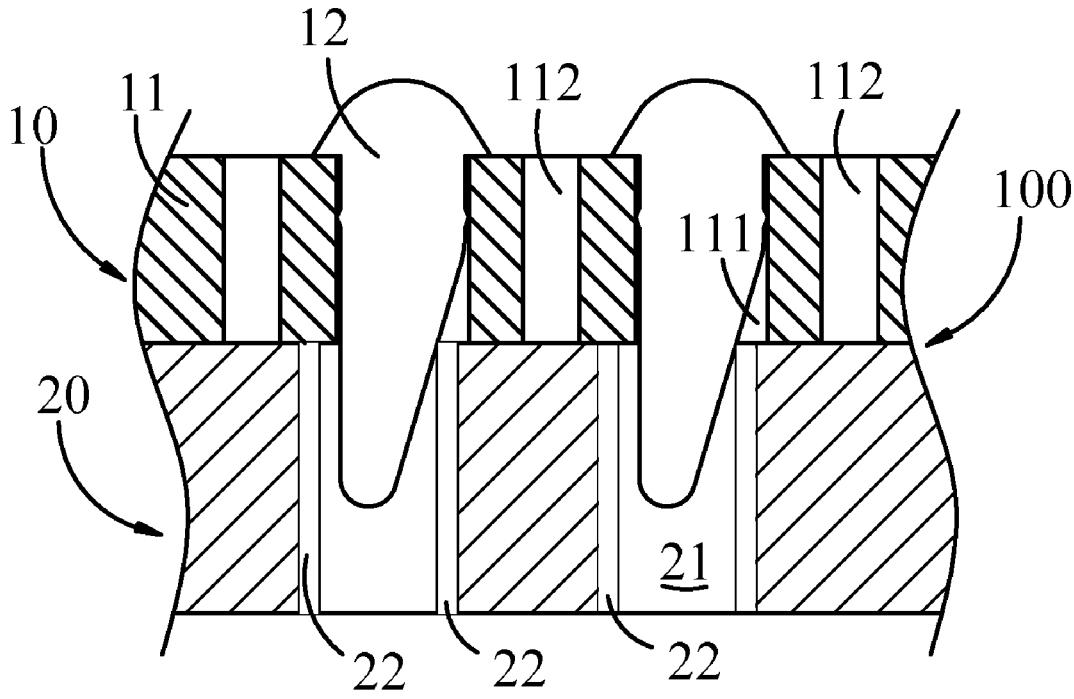
FIG. 1 is a schematic view illustrating parts of an electronic device according to the invention.
Figure 2:
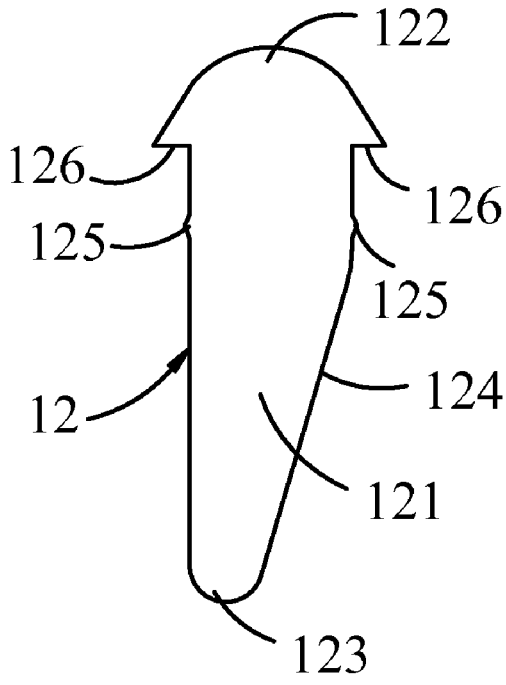
FIG. 2 is a schematic view illustrating the first conductor shown in FIG. 1.
Figure 3:
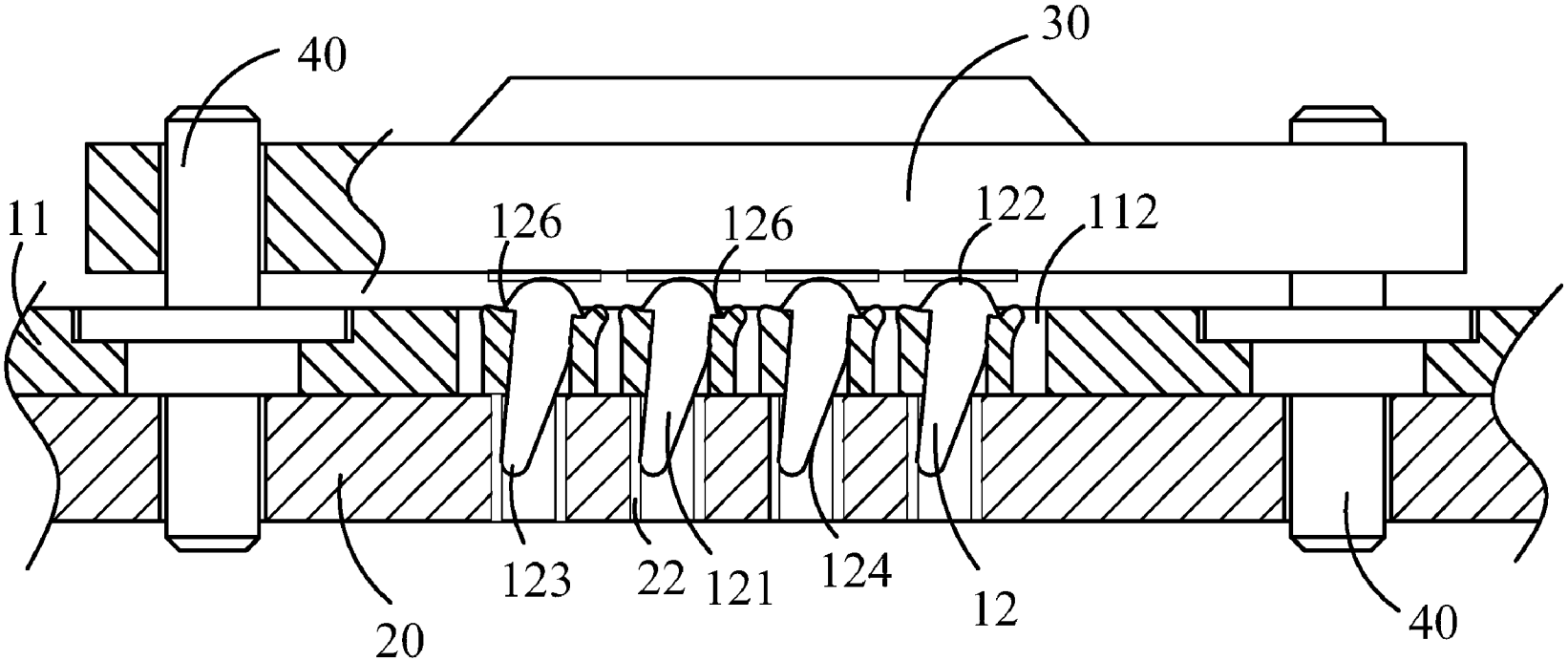
FIG. 3 is a schematic view illustrating parts of the combination of the electronic device shown in FIG. 1 and the chip module.

Please refer to FIG. 1 to FIG. 3. FIG. 1 to FIG. 3 are schematic views illustrating an electronic device of the invention before and after being combined with a chip module respectively. FIG. 2 is a schematic view illustrating a first conductor. The electronic device 100 of the invention is used to electrically connect an external electronic component 30. In this embodiment, the external electronic component 30 is a chip module (or the like).

The electronic device 100 comprises an electrical connector 10 and a base 20 combined with the electrical connector 10. The base 20 is a circuit board (or the like). The electrical connector 10 comprises an insulated body and a plurality of first conductors 12. The insulated body is an elastic body 11 having good elasticity, and has a plurality of terminal receiving holes 111 for receiving the first conductors 12. The first conductors 12 are received in the terminal receiving holes 111, and the elastic body 11 is disposed on the circuit board 20.

A plurality of holes 21 are formed in the circuit board 20. Second conductors 22 are plated on inner walls of the holes 21. The holes 21 and the terminal receiving holes 111 are staggered, and the holes 21 are partially communicated with the terminal receiving holes 111. In other words, centers of the holes 21 and centerlines of the terminal receiving holes 111 are not collinear, but are displaced from each other by a certain distance (definitely, the holes 21 can also be corresponding to the terminal receiving holes 111, the centers of the holes 21 coincide with the centers of the terminal receiving holes 111 vertically, but transverse widths of the holes 21 are smaller than transverse widths of the terminal receiving holes 111). This facilitates the deformation of the elastic body 11 after the first conductors 12 are compressed, such that the first conductors 12 are extruded towards one side to contact the second conductors 22.

An accommodation space 112 for accommodating elastic deformation of the elastic body 11 is further formed between the terminal receiving holes 111, and the accommodation space 112 penetrates throughout the elastic body 11.

The first conductors 12 are sheet-shaped. Each of the first conductors 12 comprises a main body portion 121 and a first and a second contact portions 122, 123 extending from two ends of the main body portion 121. A part of the main body portions 121 are accommodated in the terminal receiving holes 111, and the rest part of the main body portions 121 extend into holes 21 of the circuit board 20. The first contact portions 122 are in contact with the chip module 30, and the second contact portions 123 are in contact with the second conductors 22 of the circuit board 20.

A guide portion 124 is further disposed on one side of each of the main body portions 121 for guiding the direction of movement of the first conductors 12 after being compressed. A side surface of the guide portion 124 is a sloped surface, so that the main body portions 121 lean towards one side, and center of gravity of the first conductors 12 deviates to the other side facing the sloped surface. When the first conductors 12 are compressed, the first conductors 12 lean towards one side, which facilitates the contact between the first conductors 12 and the second conductors 22 of the circuit board 20.

A protrusion 125 protrudes from two sides of the main body portion 121 for latching the elastic body 11. The protrusions 125 can be used to prevent the first conductors 12 from sliding inside the terminal receiving holes 111 and leaving the terminal receiving holes 111.

Two sides of each of the first contact portions 122 extend to form a pressing portion 126 pressing on the elastic body 11. The pressing portions 126 press on two sides of the top of the terminal receiving holes 111, so as to prevent the first conductors 12 from being entirely extruded into the terminal receiving holes 111 when the first conductors 12 are compressed.

Please refer to FIG. 1 and FIG. 3. During the assembly, the electrical connector 10 and the circuit board 20 are assembled in a manner as shown in FIG. 1, such that part of the first conductors 12 extend into a hole 21 of the circuit board 20. Then, the chip module 30 is pressed on the electrical connector 10, and is firmly fixed to the electrical connector 10 through fixing devices 40 on two ends. At this time, the chip module 30 compresses the first conductors 12. The first and second conductors 12, 22 are disposed at appropriate positions. The pressing portions 126 of the first conductors 12 are made to press the elastic body 11 downwards. As the first conductors 12 have sloped surfaces, the center of gravity of the first conductors 12 deviates to the side facing the sloped surfaces, and the first conductors 12 are made to move to one side. In addition, the elastic body 11 has good elasticity, and when the first conductors 12 are compressed, the elastic body 11 has elastic deformation along the moving direction of the first conductors 12. Meanwhile, the accommodation space 112 of the elastic body 11 accommodates the elastic deformation of the elastic body 11. Finally, the first conductors 12 are deflected downward, so as to make the second contact portions 123 contact the second conductors 22 of the circuit board 20, and extrude the second conductors 22 properly (as shown in FIG. 3). Thus, the electrical connection between the electronic device 100 and the chip module 30 is established.

Figure 4:
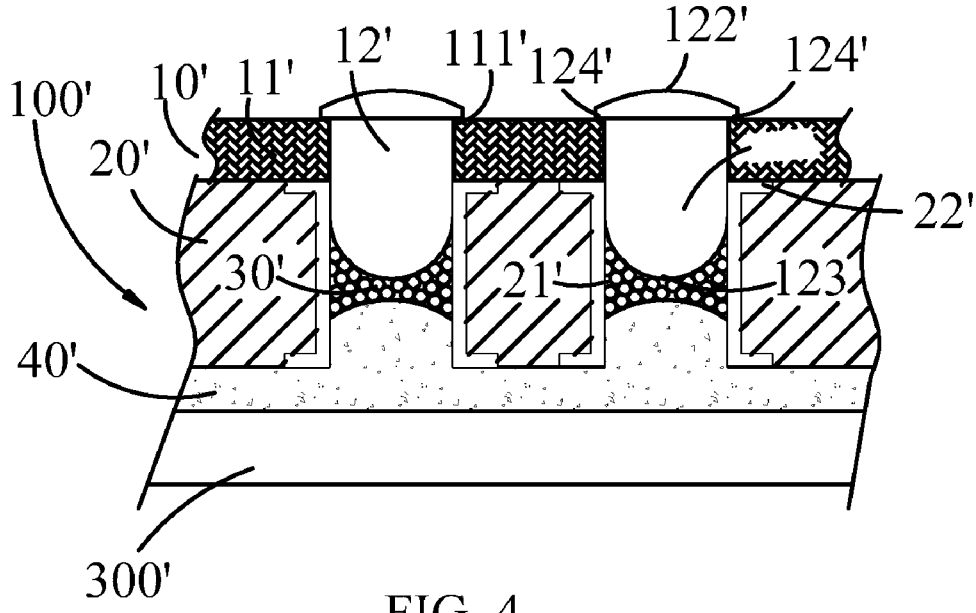
FIG. 4 is a cross-sectional view illustrating parts of the electronic device according to a second embodiment of the invention.
Figure 5:
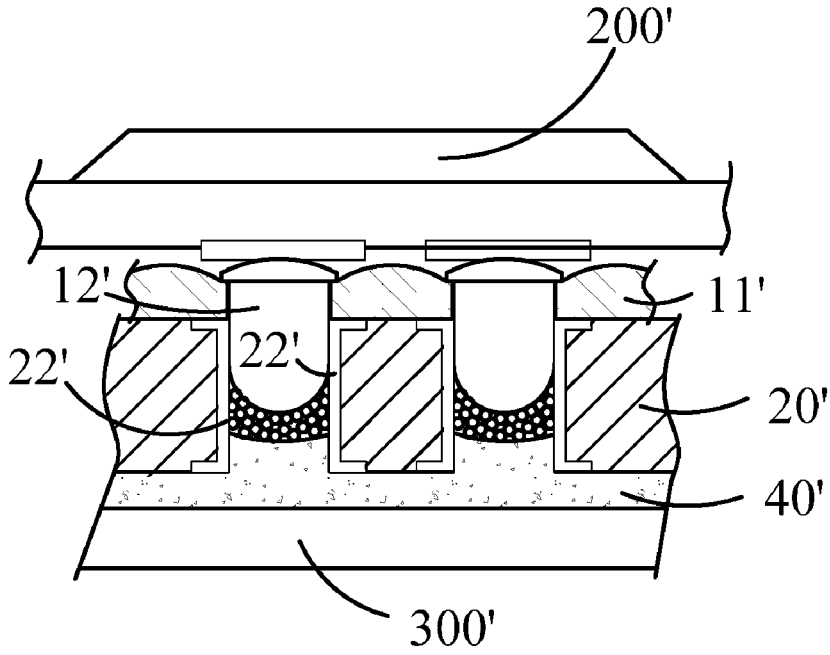
FIG. 5 is a schematic view illustrating parts of the combination of the electronic device shown in FIG. 4 and the chip module.

FIG. 4 and FIG. 5 are schematic views illustrating the electronic device according to the second embodiment of the invention before and after being combined with the chip module. The difference between the second and first embodiments is that conductive particles are used in the second embodiment. The detailed structure is described as follows.

The electronic device 100' of the invention is used to electrically connect the chip module 200'. The electronic device 100' comprises an electrical connector 10' in conjunction with a circuit board 20'. The electrical connector 10' is placed above the circuit board 20'. The electrical connector 10' can accommodate the chip module 200', so as to establish the electrical connection between the electronic device 100' and the chip module 200'.

The electrical connector 10' comprises an insulated body 11' and a plurality of first conductors 12' accommodated in the insulated body 11'. The insulated body 11' is an elastic body, and has terminal receiving holes 111' for receiving the first conductors 12'. Each of the conductors 12' includes a main body portion 121' and a first and a second contact portions 122', 123' extending from two ends of the main body portion 121' and compressed to contact the chip module 200' and conductive particles 30'. The second contact portions 123' have an arc surface, and plenty of conductive particles 300' are in contact with the arc surface. Two ends of each of the first contact portions 122' extend to form a clamping portion 124' that rests on two side surfaces of the top of each of the terminal receiving holes 111', so as to prevent the first conductors 12' from being entirely pressed into the terminal receiving holes 111' when being compressed.

The circuit board 20' has a plurality of holes 21', and second conductors 22' are disposed on inner walls of the holes 21'. One end of the first conductors 12' is disposed in holes 21', and closely contacts second conductors 22' after being pressed. A part of the main body portions 121' of the first conductors 12' are held in the terminal receiving holes 111' of the elastic body 11', and the rest part of the main body portions 121' are clamped between two second conductors 22'.

The conductive particles 30' are disposed in the holes 21', and pressed to contact the first and second conductors 12', 22' when being compressed. The electronic device 100' further comprises a plug 40'. The plug 40' has elasticity, and is made of a material such as elastic rubber. The plug 40' is disposed in the holes 21', and urges the conductive particles 30'. The holes 21' are through holes. A portion of the plug 40' is disposed in the holes 21', and another portion of the plug 40' urges the bottom of the circuit board. Moreover, the electronic device 100' is further connected with a back plate 300' externally. The plug 40' is fixed between the circuit board 20' and the back plate 300', so as to prevent the conductive particles 30' from falling off the circuit board 20'.

Figure 6:
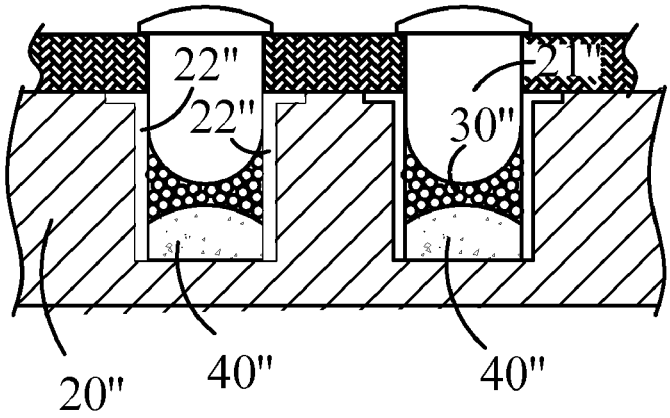
FIG. 6 is a cross-sectional view illustrating parts of the electronic device according to a third embodiment of the invention.

FIG. 6 is a schematic view illustrating the electronic device according to the third embodiment of the invention. The difference between the third and second embodiments is described as follows. The plug 40" of the third embodiment is not fixed by a back plate, but is separated to a plurality of plugs 40", and the holes 21" are blind holes. The plugs 40" are disposed at the bottom of the holes 21", i.e., each of the plugs 40" is fixed between the second conductor 22" and the circuit board 20". Moreover, the plugs 40" can also urge the conductive particles 30". Other structures and implementations are the same as those of the second embodiment, and will not be described herein again.

Figure 7:
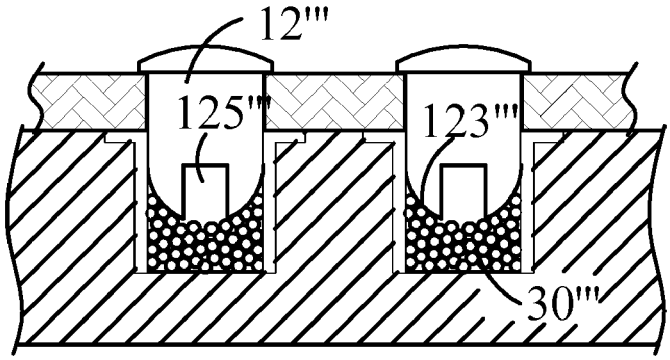
FIG. 7 is a cross-sectional view illustrating parts of the electronic device according to a fourth embodiment of the invention.
Figure 8:
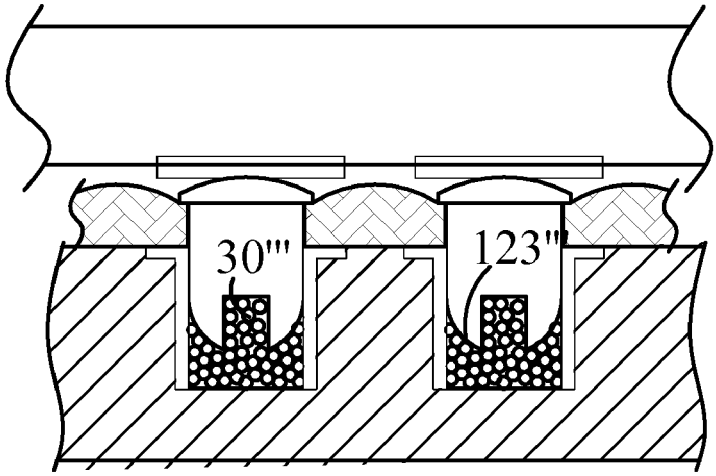
FIG. 8 is a schematic view illustrating parts of the combination of the electronic device shown in FIG. 7 and the chip module.

FIG. 7 and FIG. 8 are schematic views illustrating the electronic device according to the fourth embodiment of the invention before and after being combined with the chip module respectively. The difference between the fourth and second embodiments is described as follows. In the fourth embodiment, the plugs are not used, but a groove 125'" is formed on the arc surface of the second contact portions 123'" of the first conductors 12'". After the first conductors 12'" is compressed to contact the conductive particles 30'", part of the conductive particles 30'" are extruded into the groove 125'" (as shown in FIG. 8). Other structures and implementations are the same as those of the second embodiment, and will not be described herein again.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An electronic device electrically connected to an external electronic component, comprising:

a base having a plurality of holes;

conductive particles disposed in the holes;

an elastic body disposed on the base, the elastic body having terminal receiving holes;

first conductors, an end of the first conductors being accommodated in the elastic body, another end of the first conductors being disposed in one of the holes, the first conductors contacting the external electronic component; and second conductors disposed on inner walls of the holes of the base; and wherein the first and second conductors, the elastic body, and the conductive particles are disposed at appropriate positions, and when the external electronic component presses and contacts the first conductors, the elastic body is forced to deform, and the first conductors are made to move to extrude the conductive particles, such that the first conductors closely contact the second conductors.

2. The electronic device of claim 1, wherein the terminal receiving holes of the elastic body and the holes of the base are staggered and centerlines of the terminal receiving holes and the holes are not collinear.

3. The electronic device of claim 1, wherein the holes of the base are corresponding to the terminal receiving holes of the elastic body, and transverse widths of the holes are smaller than transverse widths of the terminal receiving holes.

4. The electronic device of claim 1, wherein the elastic body further comprises an accommodation space for accommodating elastic deformation of the elastic body.

5. The electronic device of claim 1, wherein each of the first conductors has a main body portion and a first and a second contact portions extending from two ends of the main body portion and in contact with a chip module and the second conductors respectively.

6. The electronic device of claim 5, wherein a guide portion is further disposed on one side of the main body portion, and a side surface of the guide portion is a sloped surface.

7. The electronic device of claim 5, wherein protrusions are further disposed on two sides of the main body portion for latching the elastic body.

8. The electronic device of claim 5, wherein two sides of the first contact portion extend to form a pressing portion that presses on the elastic body.

9. The electronic device of claim 1, wherein the first conductors have grooves, and a part of the conductive particles are extruded into the grooves after the first conductors are compressed to contact the conductive particles.

10. The electronic device of claim 1, wherein a plug is disposed in the holes to urge the conductive particles.

11. The electronic device of claim 10, wherein the holes are through holes, and a part of the plug is disposed in the holes, and another part of the plug urges a bottom of the base.

12. The electronic device of claim 10, wherein the electronic device is externally connected to a back plate, and the plug is retained between the holes and the back plate.

13. The electronic device of claim 10, wherein the holes are blind holes, and the plug is disposed at bottom of the holes.

14. The electronic device of claim 1, wherein the base is a circuit board.

15. The electronic device of claim 1, wherein the external electronic component is a chip module.

* * * * *